US005322454A

United States Patent [19]

Thommen

[11] Patent Number: 5,322,454

[45] Date of Patent: Jun. 21, 1994

[54] CONNECTOR FOR HELICALLY CORRUGATED CONDUIT

[75] Inventor: Robert L. Thommen, Indianapolis, Ind.

[73] Assignee: Specialty Connector Company, Inc., Franklin, Ind.

[21] Appl. No.: 990,901

[22] Filed: Dec. 15, 1992

Related U.S. Application Data

[63] Continuation-in-part of Ser. No. 968,581, Oct. 29, 1992, abandoned.

[51] Int. Cl.[5] ..... H01R 17/04

[52] U.S. Cl. ..... 439/584; 439/840

[58] Field of Search ..... 439/578-585, 439/675, 840

[56] References Cited

U.S. PATENT DOCUMENTS 3,291,895 12/1966 Van Dyke ..... 439/578
3,910,673 10/1975 Stokes ..... 439/584
4,273,405 6/1981 Law ..... 439/584
4,824,401 4/1989 Spinner ..... 439/584
4,995,832 2/1991 Thommen et al. ..... 439/578

*Primary Examiner*—David L. Pirlot
*Attorney, Agent, or Firm*—Woodward, Emhardt, Naughton, Moriarty & McNett

[57] ABSTRACT

A connector for connecting to helically corrugated conduit comprises a bolt member having a passageway therethrough and a connector body having a hollow end portion that receives the bolt member. The connector includes a collet clamp within the passageway that has a grooved gripping surface adapted to be received within the helical corrugations of the conduit. The collet clamp includes a plurality of fingers each having a radially inward directing gripping surface and a wedge-shaped outer surface. A bushing having a frustoconically shaped bore is advanced over the fingers of the collet clamp when the bolt member is attached to the connector body in order to force the fingers radially inward into gripping contact with the corrugated conduit.

15 Claims, 5 Drawing Sheets

CONNECTOR FOR HELICALLY CORRUGATED CONDUIT

CROSS-REFERENCE TO RELATED APPLICATION

This application is a continuation-in-part of copending application Ser. No. 07/968,581, filed Oct. 29, 1992, now abandoned.

BACKGROUND OF THE INVENTION

This invention relates generally to a connector for helically corrugated conduit, and in particular, to a connector for helically corrugated coaxially conducting conduit.

Several different types of connectors for helically corrugated conduit are known. For instance, U.S. Pat. No. 4,995,832 to Thommen et al. describes a connector that axially compresses a helical spring within a connector body using a bolt member. The conduit is held in place within the connector body because the helical spring is received within the corrugations of the conduit. Another connector described in U.S. Pat. No. 4,273,404 to Law employs a grounding ring having a plurality of arms that are deformed to project into the valleys of the corrugated conduit when the connector is threaded together. The arms of the grounding ring thus prevent the corrugated conduit from being withdrawn from the connector. Other connector structures of interest with respect to the present invention include U.S. Pat. Nos. 4,824,401 and 4,687,272 to Spinner, U.S. Pat. No. 3,291,895 to Van Dyke and U.S. Pat. No. 3,184,706 to Atkins.

SUMMARY OF THE INVENTION

One embodiment of the invention is a connector for helically corrugated conduit that has an axis and corrugations sloped at a pitch angle with respect to the axis. The connector includes a bolt member having a passageway therethrough sized to receive the conduit. A collet clamp is provided having a base ring with a bore extending therethrough and a plurality of fingers extending adjacent the bore in a circle about the centerline. Each of the fingers has a gripping surface, and each finger is attached to the base ring of the collet clamp by a deformable element. The gripping surfaces of the fingers can be formed to define a helical groove sloped with respect to the centerline at an angle about equal to the pitch angle of the corrugated conduit. Also included is a connector body having a hollow end portion for receiving the collet clamp and a portion of the bolt member. Means for attaching the bolt member to the connector body when the bolt member is received in the hollow end portion of the connector body is also included. Finally, there is provided means for deforming each of the deformable elements when the bolt member is attached to the connector body such that the gripping surfaces of the fingers are moved radially inward into gripping contact with the corrugations of the corrugated conduit.

One object of the present invention is to provide an improved connector for helically corrugated conduit.

Related objects and advantages of the present invention will be apparent from the following description.

DESCRIPTION OF THE PREFERRED EMBODIMENT

Figure 1:
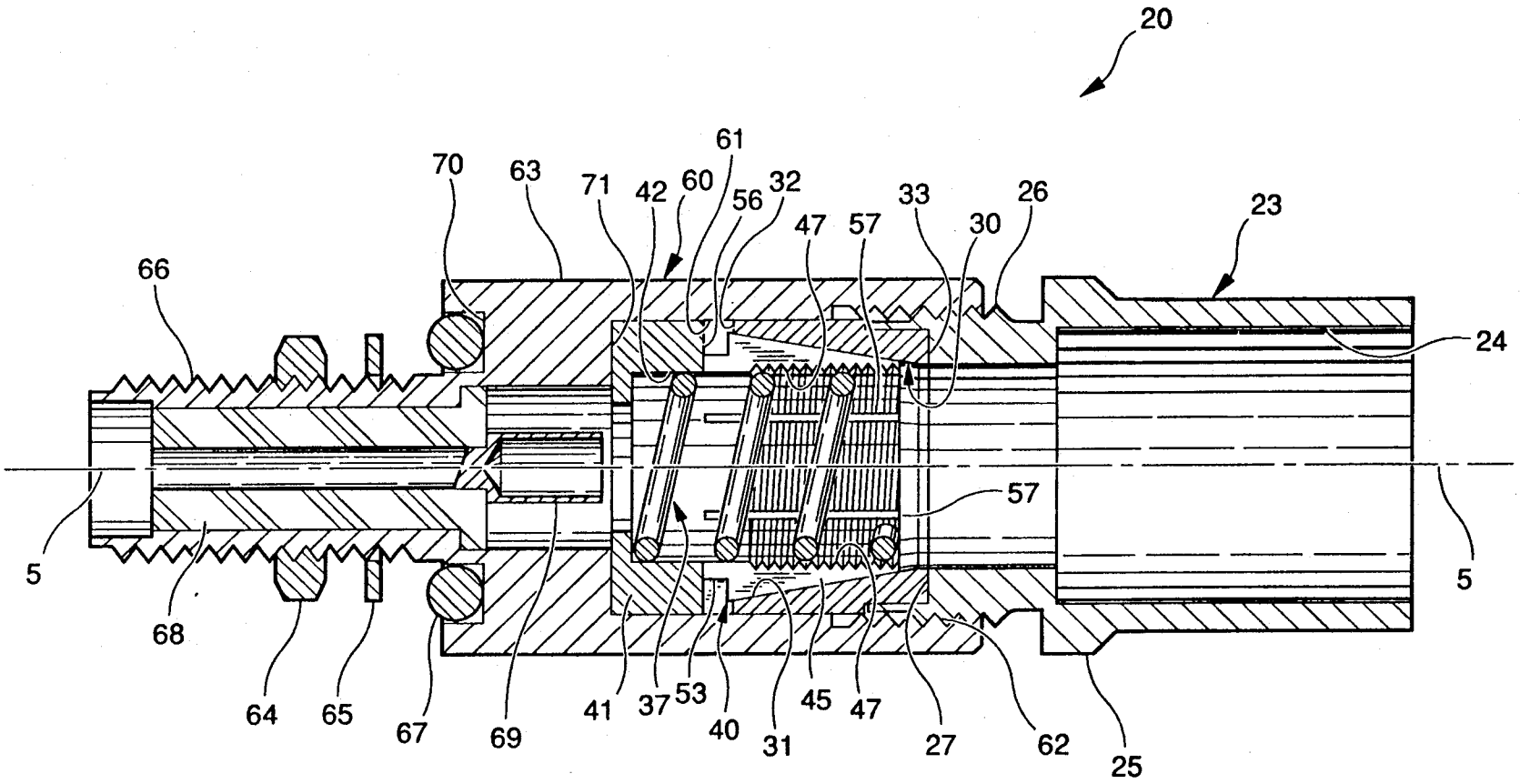
FIG. 1 is a sectioned side elevational view of a connector for corrugated according to the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a connector 20 for corrugated conduit is shown before being secured to a segment of corrugated conduit. Connector 20 includes a bolt member 23 having a stepped passageway 24 therethrough that is sized to receive corrugated conduit. Bolt member 23 also includes an outer threaded portion 26 and a hexagonal surface 25 that enables bolt member 23 to be turned around centerline 5 with an ordinary wrench of suitable size. Annular shoulder 27 of bolt member 23 abuts against end face 33 of bushing 30. Bushing 30 has a frustoconically shaped bore 31 and an annular abutment surface 32 which is opposite end face 33. Frustoconically shaped bore 31 of bushing 30 surrounds a portion of a collet clamp 40.

Collet clamp 40 includes a base ring 41 having a stepped bore 42 therethrough. Collet clamp 40 also includes six fingers 45 (FIGS. 3 and 4) that extend away from base ring 41 in a circle around centerline 5. Fingers 45 are separated by slots 57, and each finger includes an inner gripping surface 47. Each finger 45 is attached to base ring 41 via its own separate deformation element 53. A helical spring 37 is received within collet clamp 40 and preferably has a pitch angle that corresponds to the pitch angle of the helically corrugated conduit to be connected by connector 20. In order to obtain the best possible connection between connector 20 and helically corrugated conduit 10, the diameter of the wire used to make helical spring 37 preferably has a diameter that is about equal to the depth "d" of the valleys 15 of helically corrugated conduit 10 (FIG. 2).

Helical spring 37, collet clamp 40, bushing 30 and the threaded outer portion 26 of bolt member 23 are received within the hollow end portion 61 of connector body 60. Hollow end portion 61 includes inner threads 62 which match to the threads of outer thread portion 26 of bolt member 23 and allow bolt member 23 to be attached to connector body 60 via the threaded engagement shown. Connector body 60 also includes a hexagonal outer surface 63 that enables connector body 60 to be rotated about centerline 5 with an ordinary wrench of suitable size. Base ring 41 of collet clamp 40 rests against annular backstop surface 71 of connector body 60. Connector body 60 also includes an outer threaded portion 66 that cooperates with washer 65 and nut 64. Connector body 60 also includes a gasket 67 that is received in annular recess 70. Finally, connector body 60 includes a contact member 69 that is surrounded on all sides by insulator material 68 so that contact member 69 is electrically isolated from the remainder of connector body 60.

Figure 2:
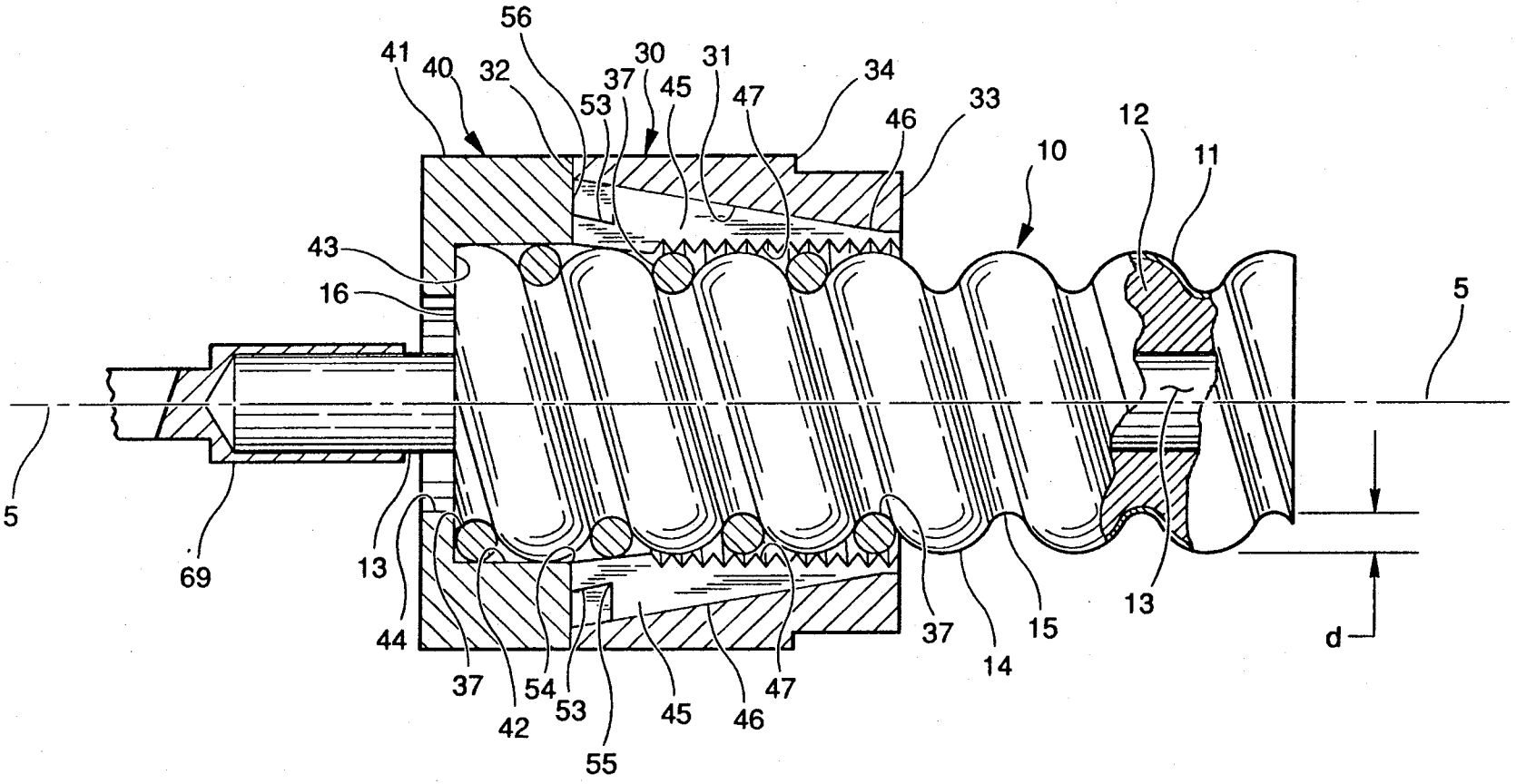
FIG. 2 is a partial sectioned side elevational view of the cable connector of FIG. 1 after being secured to a segment of helically conduit.

Referring to FIG. 2, helically corrugated conduit 10 ordinarily comprises an inner conductor 13 that is isolated from an outer jacket of conducting material 11 by dielectric material 12. Helically corrugated conduit 10 includes a plurality of consecutive ridges 14 separated by valley portions 15. The maximum outer diamter of outer conductor material 11 is substantially equal to the maximum outer diameter of its remaining portion. As a result, production and/or field service costs associated with applying an external flange or collar on the end of the conduit can be avoided. Helically corrugated conduit 10 also normally includes an outer jacket of insulative material which is not shown. Helically corrugated conduit 10 is prepared for attachment to connector 20 by first removing a portion of the outer insulative jacket and then cutting back a segment of outer insulative material 11 and dielectric material 12 so that a short protuberance of inner conducting material 13 protrudes from the end 16 of corrugated conduit 10.

Helically corrugated conduit 10 is attached to connector 20 by first threading helical spring 37 onto the end of the conduit. Next, the corrugated conduit 10 is inserted into the assembly shown in FIG. 1 until inner conducting material 13 is received in contact member 69 to form an electrical connection therebetween. Also, stepped bore 42 of collet clamp 40 produces an annular abutment surface 43 against which the end 16 of corrugated conduit 10 abuts, and a reduced diameter portion 44 through which the protuberance of inner conductive material 13 extends. Next, bolt member 23 is simply threaded into connector body 60 until abutment surface 32 of bushing 30 is pushed into contact with annular backstop surface 56 of collet clamp 40 (FIG. 2). In other words, bushing 30 is pushed over fingers 45 of collet clamp 40 by the action of bolt member 23 being threaded into connector body 60. The advancement of bushing 30 over the fingers 45 of collet clamp 40 causes the inner gripping surfaces 47 into gripping contact with both helical spring 37 and usually at least two consecutive ridges 14 of helically corrugated conduit 10.

Figure 5:
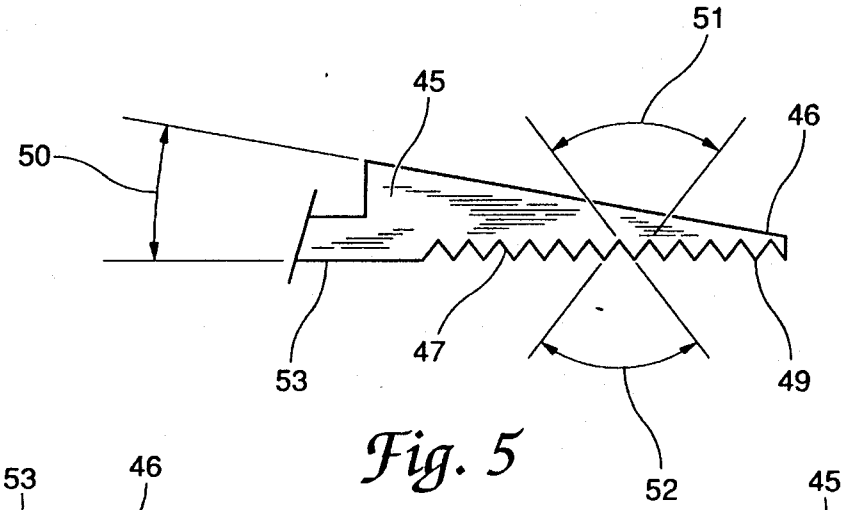
FIG. 5 is a close-up side view of one finger of the collet clamp shown in FIGS. 3 and 4.
Figure 4:
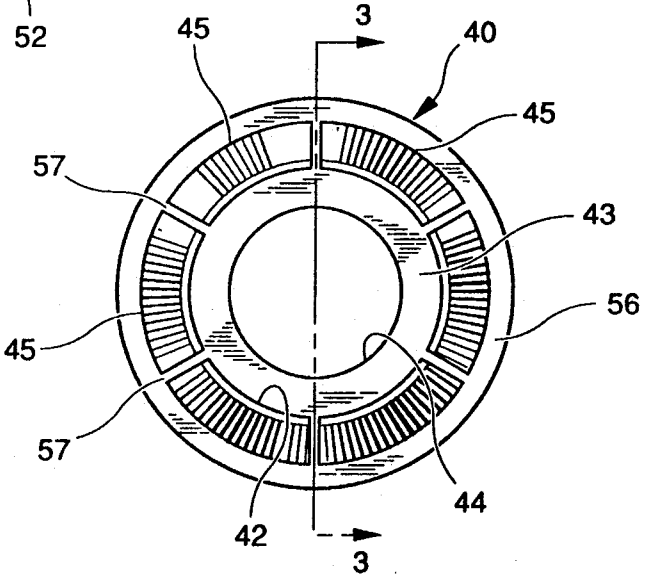
FIG. 4 is an end elevational view of a collet clamp according to one aspect of the present invention.
Figure 3:
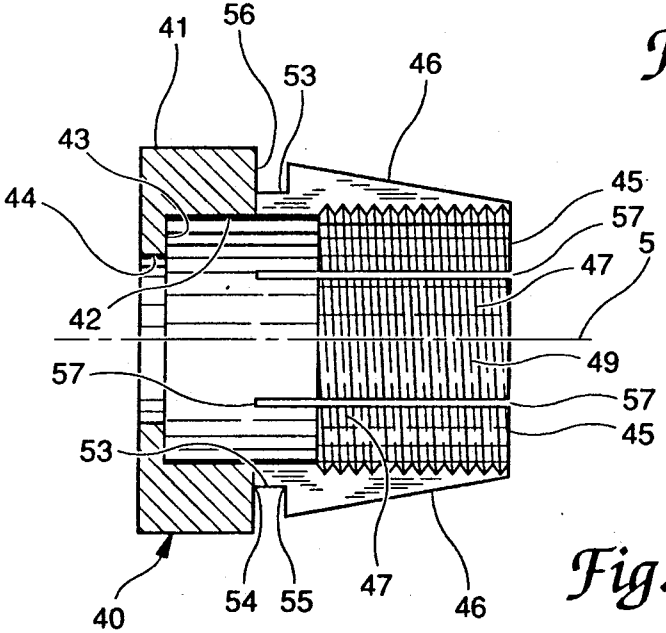
FIG. 3 is a sectioned side elevational view of the collet clamp shown in FIG. 4 and viewed along section lines 3—3.

Referring to FIGS. 3-5, the structural details of collet clamp 40 are shown. Each finger 45 is separated by an elongated slot 57 preferably having a width on the order of 0.018 inch. It is important to note that slots 57 extend all the way to base ring 41 such that each individual finger 45 is connected to base ring 41 by an individual deformation element 53. Each finger 45 has a wedge-shaped outer surface 46 that combine to define a frustoconically shaped surface that corresponds substantially to the shape of frustoconical bore 31 of bushing 30 The walls of frustoconically shaped bore 31 and the wedged shaped outer surfaces 46 of fingers 45 preferably form an angle 50 with respect to centerline 5 of about 10 degrees. The inner gripping surface 47 of each finger 45 is made up of several rows of teeth 49 Preferably having a depth on the order of 0.010 inch. Each tooth preferably has a tooth angle 51 on the order of 60 degrees and the teeth are separated by a spread angle 52 on the order of about 60 degrees. Teeth 49 are shown arranged in a spiral groove having about eighty teeth per inch.

Deformation members 53 allow the complete inner gripping surface 47 of each of finger 45 to be moved radially inward into gripping contact with both spring 37 and ridges 14 of helically corrugated conduit 10, as shown in FIG. 2. In other words, each deformation element 53 defines first and second living hinge portions 54 and 55, respectively. This dual living hinge characteristic of deformation elements 53 allows the complete inner gripping surface 47 of fingers 45 to move radially inward in step-wise fashion so that substantially all of inner gripping surface 47 on each finger is used to grip the corrugated conduit 10. Deformation members 53 are preferably on the order of 0.045 inch long and have a radial width on the order of 0.022 inch. These dimensions and the fact that collet clamp 40 is preferably made from brass annealed at approximately 1000° F. reliably produces the dual living hinge action of deformation elements 53 as shown in FIG. 2. It should be understood that the three portions of collet clamp 40 (base ring 41, deformation elements 53 and fingers 45) are integrally formed from a single piece of brass that is machined into final form and then annealed.

Connector 20 would also work with an annularly corrugated conduit if helical spring 37 was omitted. However, in the case of helically corrugated conduit 10, the addition of helical spring 37 in effect enables gripping surfaces 47 of fingers 45 to simultaneously grip both the ridges 14 and the valleys 15 of corrugated conduit 10 in order to produce a significantly stronger connection between connector 20 and conduit 10. Helical spring 37, bushing 30, connector body 60 and collet clamp 40 are preferably made from suitable conductive material so that an electrical grounding connection is made between the outer conductive material 11 of conduit 10 and these various components of connector 20.

Figure 6:
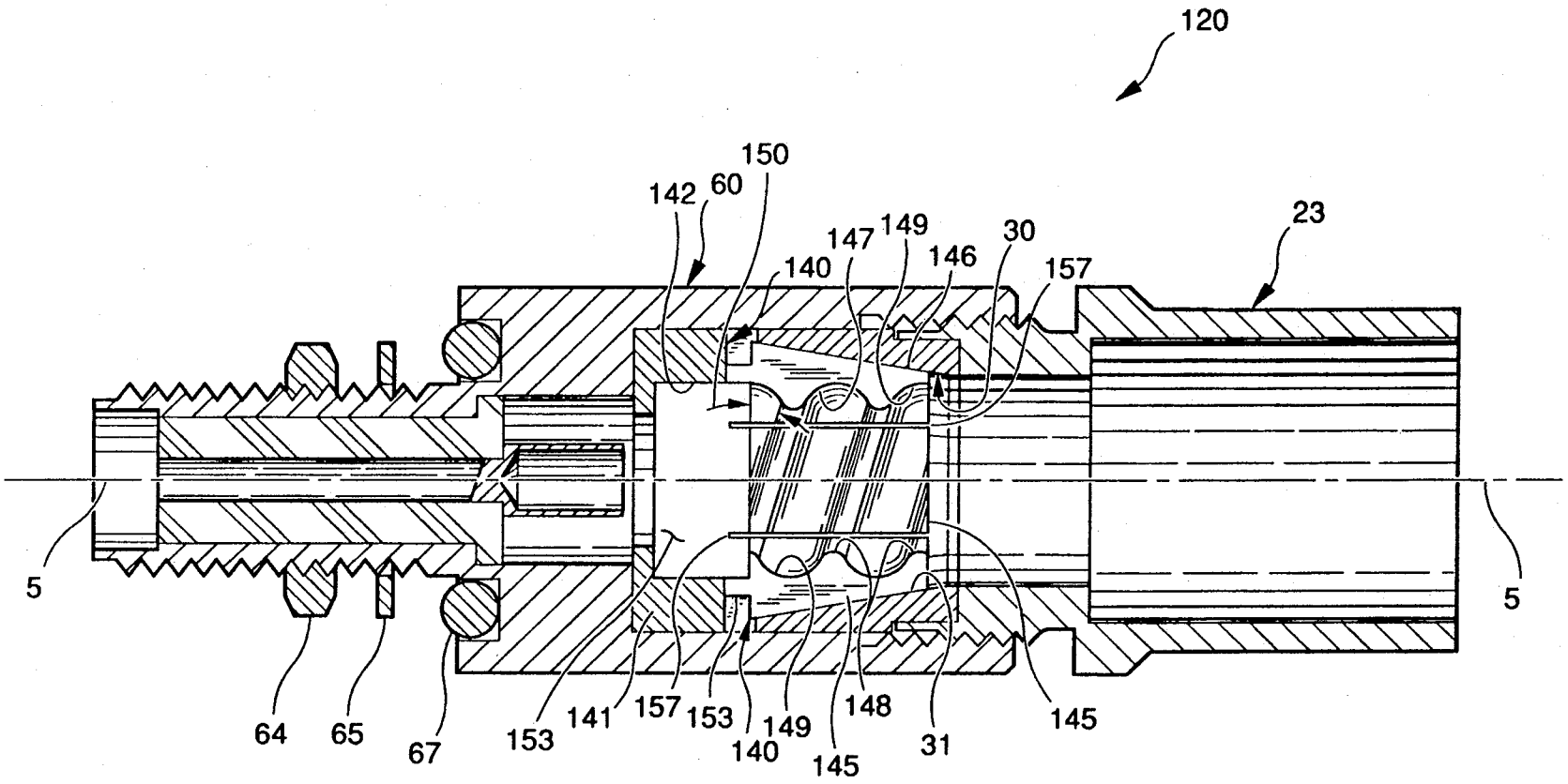
FIG. 6 is a sectioned side elevational view of a connector for helically corrugated conduit according to another embodiment of the present invention.
Figure 7:
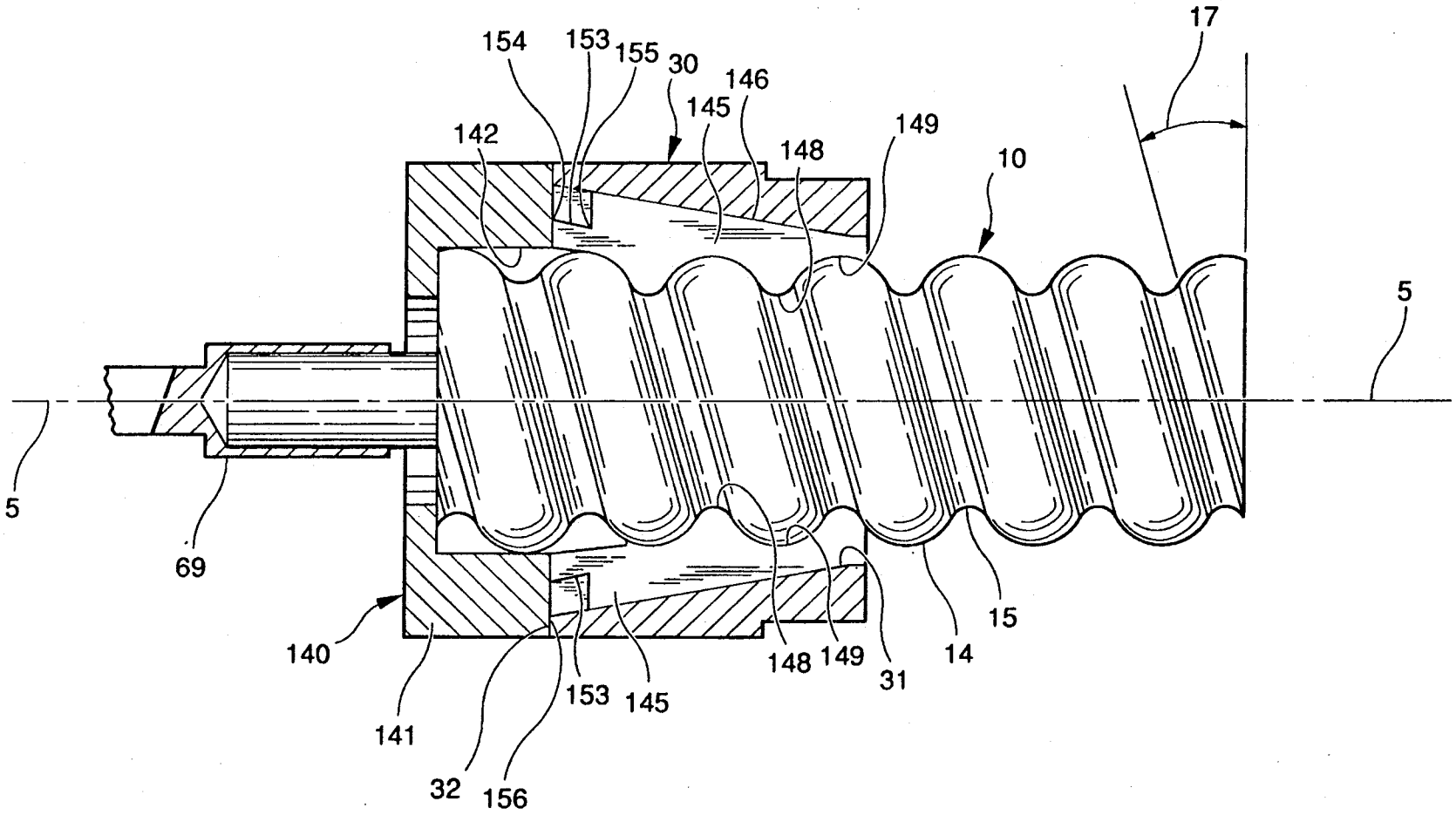
FIG. 7 is a partial sectioned side elevational view of the cable connector of FIG. 6 after being secured to a segment of helically corrugated conduit.

Referring now to FIGS. 6 and 7, a connector for helically corrugated conduit 120 is virtually identical to connector 20 except for the differences between collet clamp 140 and collet clamp 40 discussed earlier. In other words, connector 120 includes a bolt member 23, bushing 30 and connector body 60 that are all identical to their like numbered counterparts in connector 20 of FIG. 1. Collet clamp 140 is similar to collet clamp 40 discussed earlier except that in this case, gripping surfaces 147 of fingers 145 combine to define a corrugated surface that is substantially identical to that of the corrugated conduit 10 (FIG. 7). Collet clamp 140 is, however, similar to collet clamp 40 described earlier in that it includes a base ring 141 having a stepped bore 142 therethrough. Also, six fingers 145 are attached to base ring 141 by six deformation elements 153.

Fingers 145 are similar to fingers 45 discussed earlier in that each finger includes a wedged-shaped outer surface 146 that combine together to define a frustoconical surface that corresponds to frustoconical bore 31 through bushing 30. In this way, gripping surfaces 147 of the fingers are forced radially inward into gripping contact with helically corrugated conduit 10 when bushing 30 is advanced over fingers 145 as shown in FIG. 7. Each gripping surface 147 is corrugated to include at least one ridge 148 and at least one valley portion 149. Ridges 148 correspond substantially to the shape of valleys 15 of corrugated conduit 10, while valley portions 149 correspond substantially to ridge portions 14 of the helically corrugated conduit. The helical groove defined by the corrugations on inner gripping surfaces 147 of fingers 145 have a pitch angle 150 that is substantially equal to the pitch angle 17 of helically corrugated conduit 10.

Like collet clamp 40 described earlier, fingers 145 of collet clamp 140 are separated by slots 157 which extend all the way to base ring 141. Thus, each finger 145 is integrally attached to base ring 141 by a separate deformation element 153. When bushing 30 is advanced over fingers 145 until abutment surface 32 contacts annular backstop surface 156 as shown in FIG. 7, deformation elements 153 deform so that helically corrugated conduit 10 is radially crimped from all directions. Each deformation element 153 defines first and second living hinge portions 154 and 155, which enable fingers 145 to be moved radially inward in step-wise fashion so that substantially all of any inner gripping surface 147 on each finger is used to grip the corrugated conduit 10. As in collet clamp 40 described earlier, collet clamp 140 is preferably formed from a single piece of brass that is machined into final form and then annealed.

While the invention has been illustrated and described in detail in the drawings and foregoing description, the same is to be considered as illustrative and not restrictive in character. For instance, in an alternative embodiment, bushing 30 and bolt member 23 could be integrally formed into a single piece. It is to be understood that only the preferred embodiment has been shown and described and that all changes and modifications that come within the spirit of the invention are desired to be protected.

What is claimed is:

1. A connector for corrugated conduit having ridge portions separated by valley portions, the connector comprising:

a bolt member having a passageway therethrough sized to receive the conduit;

a collet clamp having a base ring with a bore extending therethrough along a centerline and a plurality of fingers extending adjacent said bore in a circle about said centerline and each of said fingers having a gripping surface, each said finger being attached to said base ring by a deformable member;

a connector body having a hollow end portion for receiving said collet clamp and a portion of said bolt member;

means for attaching said bolt member to said connector body when said portion of said bolt member is received in said hollow end portion of said connector body; and means for deforming each said deformable member when said bolt member is attached to said connector body until each said gripping surface is moved radially inward toward said centerline into gripping contact with the ridge portions of the corrugated conduit, said deformable members being dual living hinges that deform in opposite directions to define a radial step distance, wherein deformation of said living hinges causes said gripping surfaces to move radially inward said radial step distance without significant deformation of said fingers, and with said deformable members undergoing substantially all of said deformation.

2. The connector for corrugated conduit of claim 1 wherein said attaching means is a plurality of threads formed on said bolt member and a plurality of matching threads formed on said connector body.

3. The connector for corrugated conduit of claim 2 wherein said plurality of threads are formed on an outer surface of said bolt member and said plurality of matching threads are formed within said hollow end of said connector body.

4. The connector for corrugated conduit of claim 1 wherein said deforming means includes a bushing received within said connector body abutting said bolt member and having a bore extending therethrough with a portion being frustoconically shaped;

wherein said deformable members are deformed so that said gripping surfaces of said fingers are forced against the corrugations of the corrugated conduit when said portion of said bore of said bushing is advanced over said fingers of said collet clamp; and wherein said portion is pushed over said fingers when said bolt member is attached to said connector body.

5. The connector for corrugated conduit of claim 4 wherein each said finger has an outer surface opposite said gripping surface, and said outer surfaces combine to define a frustoconical shape.

6. The connector for corrugated conduit of claim 5 wherein said portion of said bore through said bushing has a wall surface; and said outer surfaces of said fingers and said wall surface of said bushing are angled with respect to said centerline at about 10 degrees.

7. A connector for helically corrugated conduit having ridge portions and valley portions that are arranged in a helix, the connector comprising:

a bolt member having a passageway therethrough sized to receive the conduit;

a collet clamp having a base ring with a bore extending therethrough along a centerline and a plurality of fingers extending adjacent said bore in a circle about said centerline and each of said fingers having a gripping surface, each said finger being attached to said base ring by a deformable member;

a connector body having a hollow end portion for receiving said collet clamp and a portion of said bolt member;

means for attaching said bolt member to said connector body when said portion of said bolt member is received in said hollow end portion of said connector body;

means for deforming each said deformable member when said bolt member is attached to said connector body until each said gripping surface is moved radially inward toward said centerline into gripping contact with the ridge portions of the corrugated conduit;

a helical spring at least partially surrounded by said collet clamp and adapted to be received within the valley portions of the corrugated conduit; and said gripping surfaces of said fingers are forced into gripping contact with said spring and the ridge portions of the corrugated conduit by said deforming means when said bolt member is attached to said connector body.

8. A connector for helically corrugated conduit that defines an axis and has corrugations sloped at a pitch angle with respect to the axis, the connector comprising:

a bolt member having a passageway therethrough sized to receive the conduit;

a collet clamp having a base ring with a bore extending therethrough along a centerline and a plurality of fingers extending adjacent said bore in a circle about said centerline and each said finger being attached to said base ring by a deformable element, each said finger having a grooved gripping surface and said gripping surfaces of said fingers combine to define a helical groove sloped with respect to said centerline at an angle about equal to the pitch angle of the corrugated conduit;

a connector body having a hollow end portion for receiving said collet clamp and a portion of said bolt member;

means for attaching said bolt member to said connector body when said portion of said bolt member is received in said hollow end portion of said connector body; and means for deforming each said deformable element when said bolt member is attached to said connector body until each said gripping surface is moved radially inward toward said centerline into gripping contact with the corrugations of the corrugated conduit, wherein deformation of said living hinges causes said gripping surfaces to move radially inward without significant deformation of said fingers, and with said deformable members undergoing substantially all of said deformation.

9. The connector for helically corrugated conduit of claim 8 wherein said gripping surfaces of said fingers combine to define a corrugated surface substantially identical to the corrugated conduit.

10. The connector for helically corrugated conduit of claim 8 wherein said deformable elements are dual living hinges that deform in opposite directions to define a radial step distance; and wherein said gripping surfaces are moved radially inward said radial step distance when said deformable elements are deformed.

11. The connector for helically corrugated conduit of claim 8 wherein said attaching means is a plurality of threads formed on said bolt member and a plurality of matching threads formed on said connector body.

12. The connector for helically corrugated conduit of claim 11 wherein said plurality of threads are formed on an outer surface of said bolt member and said plurality of matching threads are formed within said hollow end of said connector body.

13. The connector for helically corrugated conduit of claim 8 wherein said deforming means includes a bushing received within said connector body abutting said bolt member and having a bore extending therethrough with a portion being frustoconically shaped;

wherein said deformable elements are deformed so that said gripping surfaces of said fingers are forced against the corrugations of the corrugated conduit when said portion of said bore of said bushing is advanced over said fingers of said collet clamp; and wherein said portion is pushed over said fingers when said bolt member is attached to said connector body.

14. The connector for helically corrugated conduit of claim 13 wherein each said finger has an outer surface opposite said gripping surface, and said outer surfaces combine to define a frustoconical shape.

15. The connector for helically corrugated conduit of claim 14 wherein said portion of said bore through said bushing has a wall surface; and said outer surfaces of said fingers and said wall surface of said bushing are angled with respect to said centerline at about 10 degrees.

* * * * *